United States Patent [19]

Kluge

[11] Patent Number: 4,939,866

[45] Date of Patent: Jul. 10, 1990

[54] WINDOW GUARD ASSEMBLY

[75] Inventor: Richard G. Kluge, Pell Lake, Wis.

[73] Assignee: John Sterling Corporation, Richmond, Ill.

[21] Appl. No.: 478,718

[22] Filed: Feb. 8, 1990

Related U.S. Application Data

[63] Continuation of Ser. No. 275,321, Nov. 22, 1988, abandoned.

[51] Int. Cl.[5] ..... E06B 3/68

[52] U.S. Cl. ..... 49/55; 160/225

[58] Field of Search ..... 49/55, 57, 54, 50; 160/220, 221, 222, 223, 228, 373, 372; 52/106

[56] References Cited

U.S. PATENT DOCUMENTS

| | | | |
|---|---|---|---|
| D. 209,818 | 1/1968 | Udin | D25/53 |
| 314,441 | 5/1886 | Beatty | 160/372 |
| 1,552,612 | 9/1925 | Kelly | 160/102 |
| 1,715,208 | 5/1929 | Micklin | 160/104 |
| 2,422,547 | 6/1947 | Hawkins et al. | 160/223 |
| 2,698,656 | 1/1955 | Levey | D25/53 |
| 2,972,825 | 2/1961 | Stilwell et al. | 49/55 |
| 3,224,048 | 12/1965 | Sullivan | 49/57 |
| 4,394,805 | 7/1983 | Napper | 49/55 |
| 4,437,265 | 3/1984 | Turro | 49/57 |
| 4,671,012 | 6/1987 | Merklinger et al. | 49/55 |

*Primary Examiner*—James R. Brittain
*Assistant Examiner*—Gerald A. Anderson
*Attorney, Agent, or Firm*—McCaleb, Lucas & Brugman

[57] ABSTRACT

A window guard assembly made up of two, slidably coupled, generally U-shaped, members each comprising parallel spaced, elongated, linear legs integrally interjoined at one end to a transverse portion which lies in a plane parallel to the plane of the legs. In assembly the transverse portion of each member extends laterally outwardly and around the legs of the other member. As a consequence, the two members may be assembled slidably with adjacent legs of the two members co-planar and the transverse portions thereof disposed on opposite sides of the assembled members. The outer of free ends of the legs are attachable to window frame members for mounting the guard assembly across a window opening. In a first modified version, each guard member includes three elongated legs attached to a transverse portion and in a second modified version, the transverse portion of each of member is welded to the ends of the legs.

5 Claims, 3 Drawing Sheets

WINDOW GUARD ASSEMBLY

"This is a continuation of copending application(s) Ser. No. 07/275,321 filed on 11/22/88 now abandoned"

This invention relates generally to security devices and more particularly to improvements in guards or burglar bars for deterring unwanted passage through window openings and the like.

In the past, a variety of window guard assemblies have been developed to prevent or deter entry from the outside, while at the same time preventing small children, for example, from falling through the open window.

In most instances such previously known assemblies have been fabricated from a plurality of interconnected transverse metal rods and bar elements joined by welding, rivets or other fastening devices to form a protective grille, usually having intersecting members adapted to be adjusted to accommodate variations in the size of the window opening. In the usual case the guard is mounted across a window opening and fastened to the window frame. Such known multi-part structures are expensive and time-consuming to manufacture and assemble and are particularly difficult to paint or otherwise protectively coat in their assembled state.

It is a principal object of this invention to provide an improved, simplified window guard assembly.

It is another important object of this invention to provide a window guard assembly made up of two members which are formed to wrap around one another in such a manner that they are securely coupled in slidable relationship for adjustment to fit various size window openings.

It is another important object of this invention to provide a window guard assembly made up of two slidably interfitted members adapted be protectively coated prior to assembly.

It is still a further object of this invention to provide an economical, low cost window guard assembly that is distinguished by it simplicity of construction, installation and operation without sacrificing its protective qualities.

A further important object of this invention is to provide a window guard assembly made up of two generally U-shaped members arranged to wrap around one another in slidable coupled relation when assembled; the legs of each member being tied together by a transverse portion such that the legs reinforce one another against external forces.

Having described this invention, the above and further objects, features and advantages thereof will be recognized by those with skill in the art from the following detailed description of preferred and modified embodiments thereof, illustrated in the accompanying drawings and representing the best mode presently contemplated for enabling those with skill in the art to practice this invention.

IN THE DRAWINGS

DESCRIPTION OF THE PREFERRED EMBODIMENT

Figure 1:
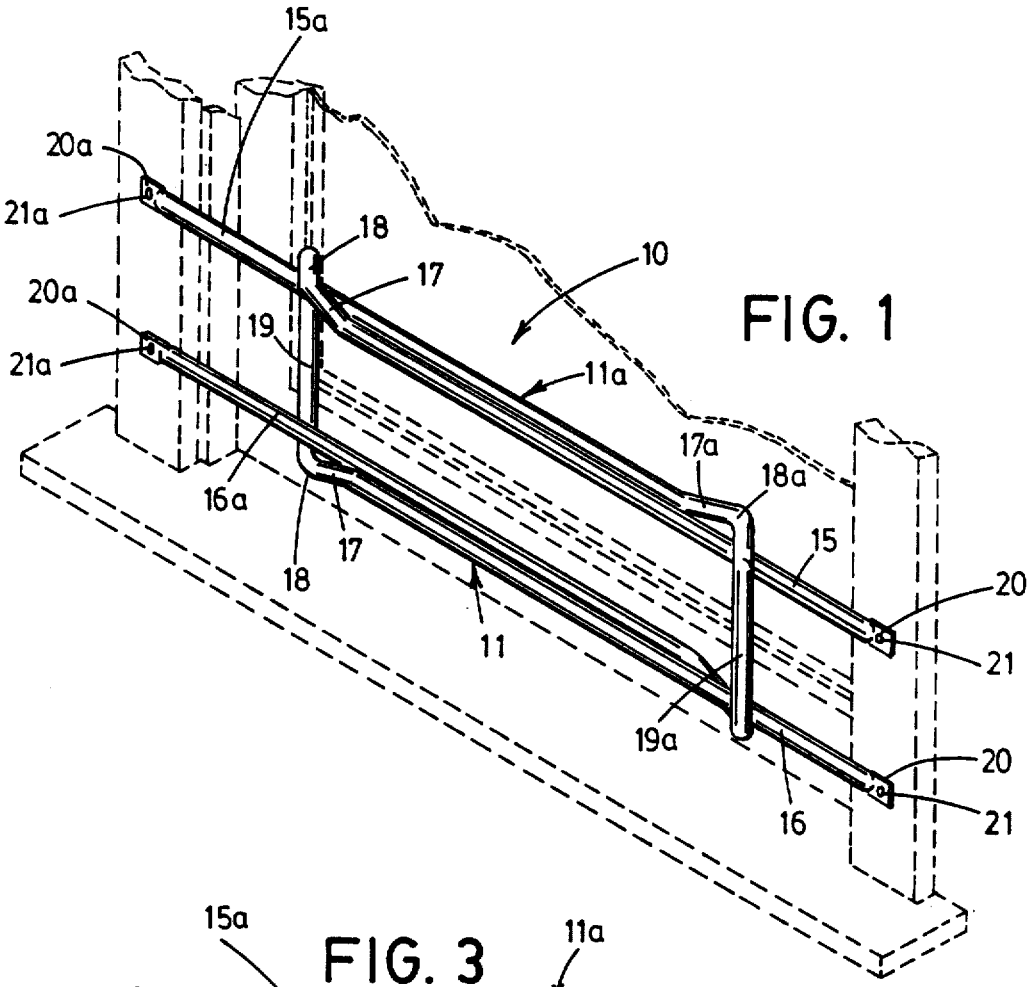
FIG. 1 is a perspective view of a preferred window guard assembly of this invention showing the same in its mounted relationship to a window frame, indicated by dotted lines.

With initial reference to FIG. 1 of the drawings, the improved window guard assembly of this invention is indicated generally at 10. This assembly comprises a pair of preferably identical monolithic guard members designated 11 and **11*a* which are slidably interfitted in assembly and adapted to be mounted across a window opening by connecting the outer ends of the guard members to the inside window casing or frame members, illustrated by dotted lines in FIG. 1**.

Inasmuch as the individual guard members 11 and **11*a*** are alike, a detailed description of one will suffice for both; various portions of the one described member being sequentially numbered and corresponding portions of the other member bearing corresponding numbers with the suffix "a".

Turning to the features of the illustrated primary member 11, it will be understood that such comprises a unitary or one-piece length of metal rod, of a suitable size and shape, depending on requirements, such as ⅜" diameter steel rod. Such rod is suitably formed to devise a substantially U-shaped member, as shown in FIG. 1. To that end, the guard member 11 comprises a pair of equal length elongated linear legs 15, 16 which lie in parallel, co-planar relationship. At one end the legs are formed and shaped to provide integral connector means comprising twin portions 17, 17 and 18, 18 which join the leg ends to a transverse portion 19. Portions 17, 17 lie in the plane of legs 15 and 16, but diverge laterally outwardly in angularly intersecting relationship to the longitudinal axes of the legs. Further, as shown, portions 17, 17 are of equal length and the ends thereof which lie outwardly of legs 15, 16 merge with co-planar parallel portions 18, 18 that angularly intersect the plane of the legs and portions 17, 17.

Co-planar with portions 18, 18 and extending between the outer ends thereof is a single transverse portion 19 comprising a linear member, offset parallel to the plane of legs 15, 16 and associated portions 17, 17.

The opposite or free end of each of the legs 15 and 16, is suitably distorted or flattened to provide a mounting portion 20 having a central opening 21 receptive of a screw fastener or the like for connecting the assembled members 11 and **11*a* cross the window frame, as illustrated in FIG. 1**.

Figure 3:
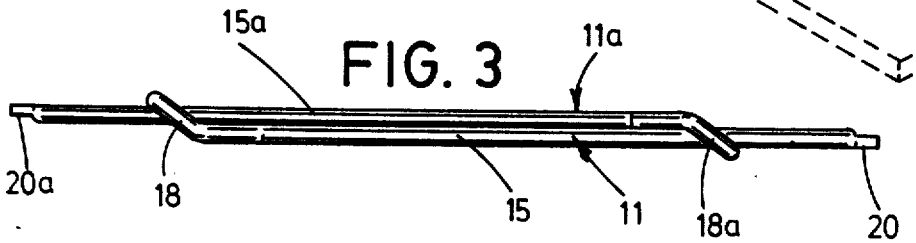
FIG. 3 is a top plan thereof.
Figure 2:
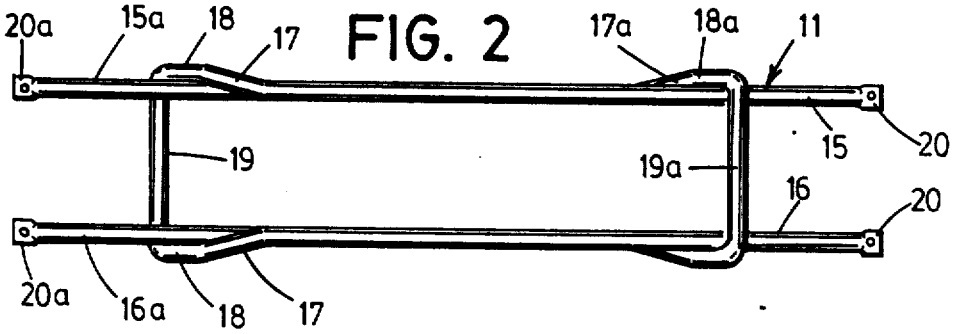
FIG. 2 is a front elevation of the window guard assembly shown in FIG. 1.
Figure 5:
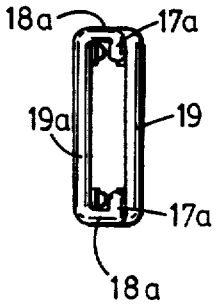
FIG. 5 is an end elevation thereof.
Figure 4:
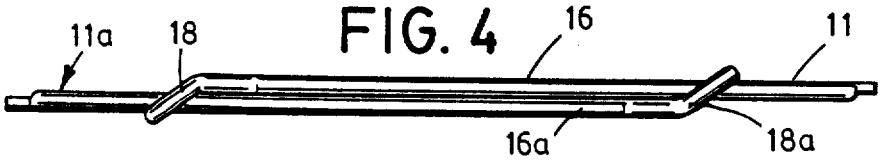
FIG. 4 is a bottom plan thereof.

In order to assemble members 11 and **11*a* to formulate guard assembly 10, legs 15, 16 of member 11 are disposed to extend beneath transverse portion 19*a* of member 11*a* while legs 15*a* and 16*a* of the latter member are similarly disposed beneath portion 19 of member 11. It is to be noted from FIGS. 2–4 that the portions 19, 19*a* are located on opposite sides of assembly 10, so that the members 11 and 11*a* are slidably held therebeneath and adapted for adjustable positioning relative to each other to accommodate variations in window opening size. In their assembled relationship the legs of the two members 11 and 11***a* are superposed and serve to reinforce and rigidify one another while providing minimum obstruction to the viewer. It will be seen from FIGS. 1 and 2, that the portions 17, 18 and 17*a*, 18*a* of their respective members 11, 11*a* extend laterally outwardly of and wrap around the assembled legs in conjunction with the transverse portions 19, 19*a* to positively hold the members 11 and 11*a* firmly together in sliding relationship.

Mounting of the guard assembly to the inside casing or frame of the window opening is accomplished by driving screws or other fasteners through the fastening openings 21 and 21*a* into the window frame. While only one assembly 10 is shown attached to the window frame, more than one such assembly may be used per window to provide a desired security barrier. Further, the guards may extend vertically instead of horizontally as shown.

Because of the simplicity of construction of the two members 11 and 11*a*, it is readily perceived that when such members are identical, the manufacture, assembly and inventory of parts for assembly 10 is greatly simplified. Of additional significance is the fact that the two individual assembly members may be easily and uniformly painted or otherwise protectively coated prior to assembly, thereby avoiding the difficult coating problems encountered in the multi-piece guard assemblies of the prior art.

First Modified Assembly

Figure 8:
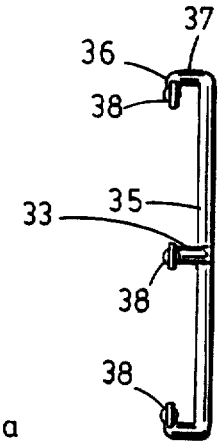
FIG. 8 is a right end elevation of a single guard member of the FIG. 6 assembly.
Figure 6:
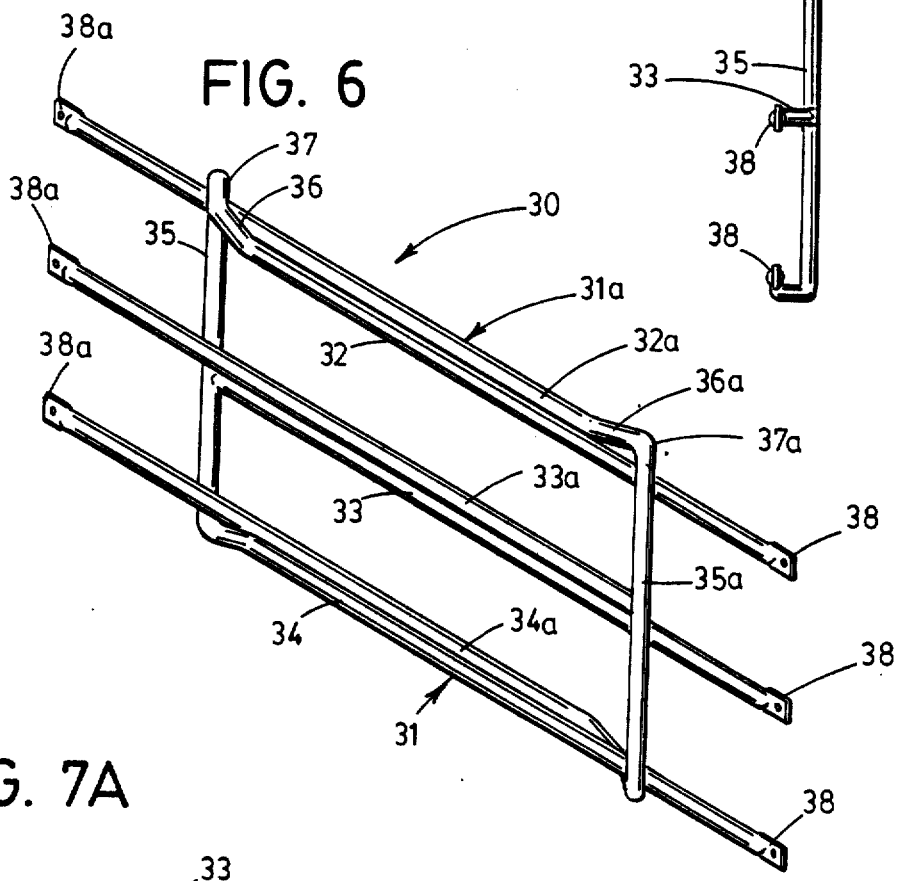
FIG. 6 is a perspective view of a first modified window guard assembly.
Figure 7A:
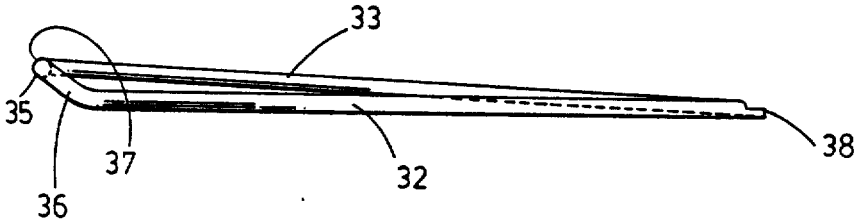
FIG. 7A is a top plan of a single guard member of the FIG. 6 assembly.
Figure 7:
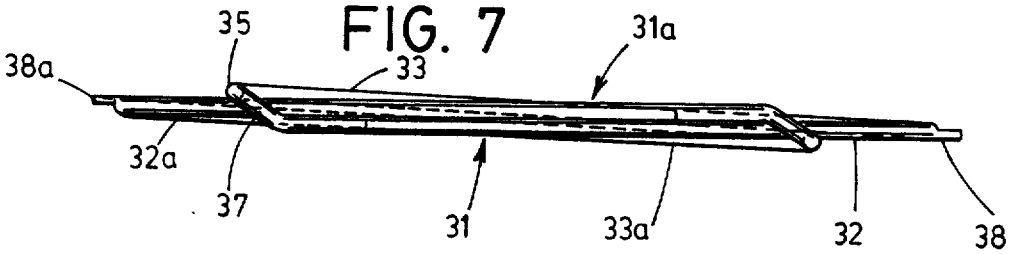
FIG. 7 is a top plan thereof.

In FIGS. 6–8 the features of a first modified version of the aforedescribed guard assembly are illustrated. As shown, a modified guard assembly, indicated generally by 30, comprises a pair of identical guard members 31, 31*a* adapted to be slidably interfitted as in the first described assembly 10.

Since members 31, 31*a* are alike a description of member 31 will suffice for both; corresponding parts of member 31*a* bearing like numerals with a suffix "a".

Guard member 31 comprises a substantially U-shaped member having three substantially parallel legs 32, 33, and 34, which are interjoined at one end with a transverse portion 35. Two of the legs 32 and 34, (outer legs) are joined to the ends of portion 35 by intervening twin connector portions 36, 36 and 37, 37, corresponding to and formed the same as portions 17 and 18 of member 11 in the first described assembly 10. The third leg 33 lies medially of the transverse portion 35 and is attached thereto at one end as by welding. Thus one end of leg 33 lies in the plane of portion 35, and out of the plane of legs 32 and 34 (see FIG. 7A). However, leg 33 extends angularly downwardly from portion 35 so that the outer end thereof, formed to provide mounting portion 38, lies in co-planar relation with like mounting portions 38 at the outer ends of legs 32 and 34 (see FIG. 7A).

The presence of the intermediate legs 33 and 33*a* on the two guard members of assembly 30, constitutes the principle difference thereof over assembly 10, first described. In this respect two or more legs 33, 33*a* may be provided on each member 31, 31*a* in the manner described for increased security, as desired. It will be understood that members 31 and 32 slidably interfit and are attached to the window frame, in the same manner as assembly 10 of FIG. 1.

Second Modified Assembly

Figure 9:
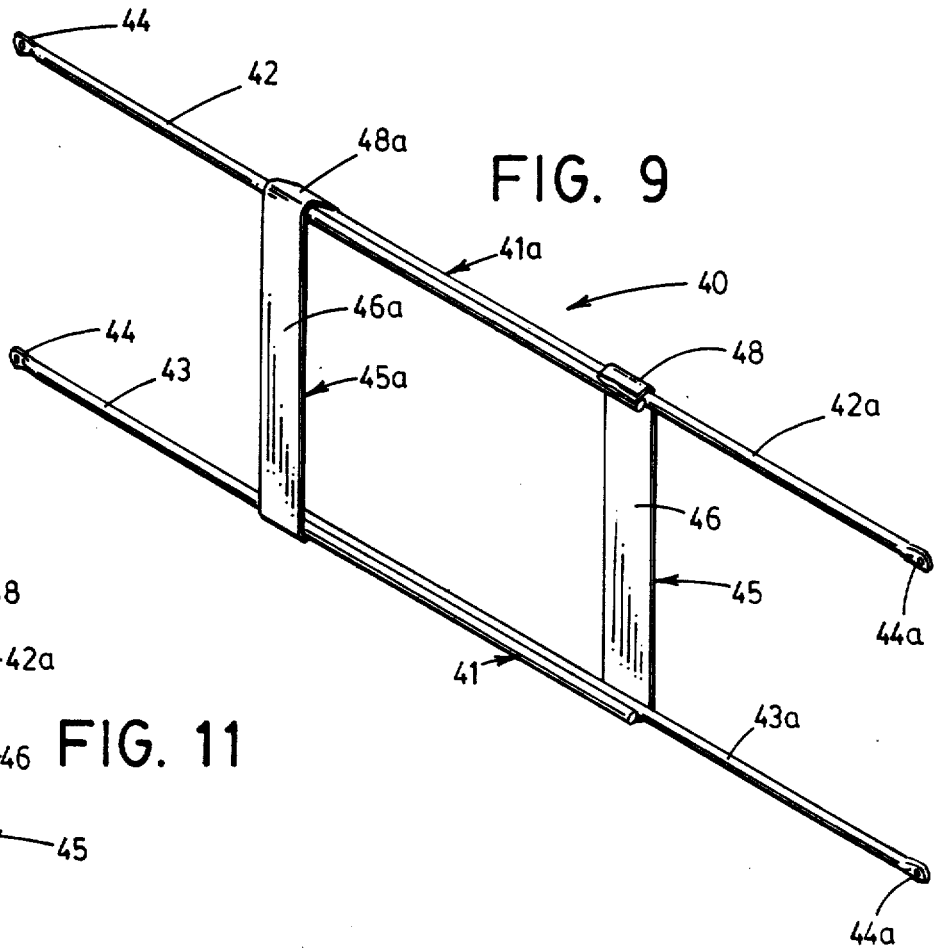
FIG. 9 is a perspective view of a second modified window guard assembly.
Figure 11:
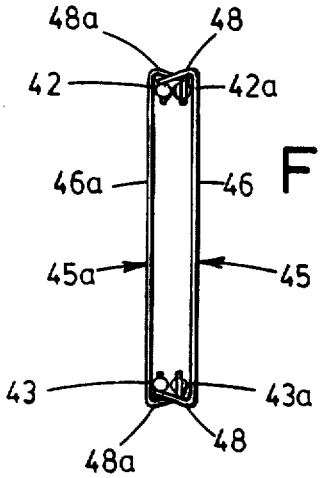
FIG. 11 is an end elevation thereof.
Figure 10:
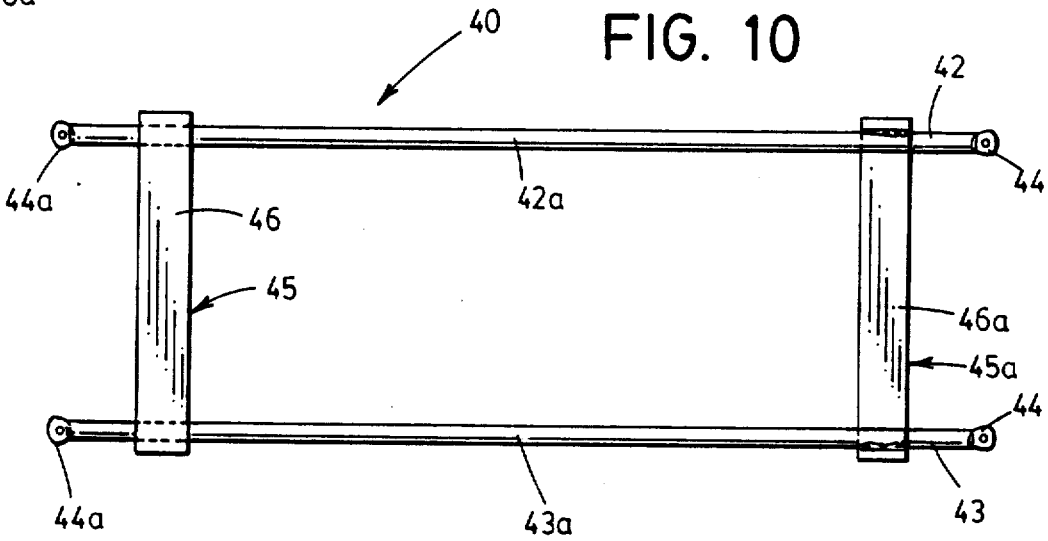
FIG. 10 is a rear elevation thereof.

In FIGS. 9–11 of the drawings a further modified guard assembly 40 is shown comprising a pair of slidably interconnected substantially U-shaped guard members 41 and 41*a* of like formation.

As in the previously described assemblies 10 and 30, one member 41 will be described herein in detail, with corresponding parts of member 41*a* bearing suffix "a".

As best shown in FIG. 9, member 41 comprises a pair of linear, parallel spaced, elongated legs 42 and 43, having mounting portions 44 at one end and interconnected at their opposite ends by a transverse portion 45.

Portion 45 constitutes the major departure over the guard members of the first two described embodiments of this invention. As shown best in FIGS. 9 and 11, portion 45 comprises an elongated metal strap having a planar body portion 46 which extends transversely across and between the outer ends of the spaced leg members 42 and 43. The length of body portion 46 is slightly greater than the spacing between legs 42 and 43 and the outer ends thereof are bent in angular relation to the plane of the body portion to provide connector portions 48, 48 extending either convergently therefrom as shown (see FIG. 11) or at right angles thereto. Such connector portions are fixedly secured, as by welding, to the outside of the legs 42, 43. This provides a wrap-around structure capable of slidably receiving the legs 42*a*, 43*a* of the other guard member 41*a* between the extending connector portions 48 to hold such legs beneath the transverse portion 45 in assembly and vice versa (see FIGS. 10 and 11). It will be noted that corresponding legs of the assembled members 41, 41*a* lie in superposed relation as in the first two described assemblies 10 and 30 which in conjunction with the transverse portions serves to add substantial rigidity and resistance to flexing of the legs by any force applied.

Mounting of assembly 40 is accomplished by driving screws through mounting portions 44 to secure opposite ends of the assembly to window frame members, as in assembly 10, first described.

In view of the foregoing it is believed that those familiar with the art will readily recognize and appreciate the novel advancement of this invention over the prior art and will understand that while the same has been described in association with preferred and modified embodiments thereof, the same is susceptible to change, modification and substitution of equivalents without departing from the spirit and scope of its teachings which are intended to be unlimited by the foregoing except as may appear in the following appended claims.

The embodiments of the inventions in which an exclusive property or privilege is claimed are defined as follows:

1. A window guard assembly comprising:

two, unitary, generally U-shaped, rigid members of identical form and structure; each member having a pair of like, rigid co-planar, parallel, laterally spaced, linear legs, and means for interjoining said legs at one end; the opposite ends of said legs being free for attachment to suitable supports;

said means comprising a transverse portion extending across said one end of each member in offset parallelism to the plane of the legs thereof, and a pair of connector portions joining said legs with the outer ends of said transverse portion;

the connector portions of each member being configured and arranged to freely and openly receive the laterally spaced legs of the other member therebetween so that said other member's legs are only partially engaged by said connector portions;

whereby said two members are adapted to be slidably assembled and disassembled with each member positioned in inverted, superposed relation with respect to the other member and the transverse and the connector portions of each member cooperating to partially embrace and guide the legs of the other member for sliding movement.

2. The window guard assembly claim 1, wherein the transverse portion of said members is joined to one end of at least three like elongated parallel legs; two of said legs lying in co-planar relationship and being joined to the opposite ends of said transverse portion by said connector portions; the third leg lying intermediate said two legs and being connected at one end directly to said transverse portion with the other end of said third leg lying in the plane of said two legs.

3. The assembly of claim 1, wherein each of said members is a one piece structure formed of a single length of rigid metal.

4. The assembly of claim 1, and mounting means at the free end of each of said legs for independently securing the same directly to a window frame whereby to mount the assembly in operating position across a window opening.

5. The window guard assembly of claim 1, wherein said transverse portion, connector portions and legs of each member integrally formed from a single length of rigid material.

* * * * *

UNITED STATES PATENT AND TRADEMARK OFFICE

CERTIFICATE OF CORRECTION

PATENT NO. : 4,939,866

DATED : July 10, 1990

INVENTOR(S) : Richard G. Kluge

It is certified that error appears in the above-identified patent and that said Letters Patent is hereby corrected as shown below:

Col. 5, line 14, after "portion" insert -- of each --.

Signed and Sealed this

Seventeenth Day of September, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,939,866

DATED : July 10, 1990

INVENTOR(S) : Richard G. Kluge

It is certified that error appears in the above-identified patent and that said Letters Patent is hereby corrected as shown below:

Col. 5, line 14, after "portion" insert -- of each --.

Signed and Sealed this

Seventeenth Day of September, 1991

*Attest:*

*Attesting Officer*

HARRY F. MANBECK, JR.

*Commissioner of Patents and Trademarks*